US005360114A

United States Patent [19]

Weidt

[11] Patent Number: 5,360,114

[45] Date of Patent: Nov. 1, 1994

[54] NESTABLE TRANSPORT CONTAINER

[75] Inventor: Karl Adolf Weidt, Siegen, Germany

[73] Assignee: Fritz Schafer Gesellschaft mit Beschrankter Haftung

[21] Appl. No.: 215,806

[22] Filed: Mar. 22, 1994

[30] Foreign Application Priority Data

Mar. 30, 1993 [DE] Germany ..... 4310392

[51] Int. Cl.[5] ..... B65D 21/06; B65D 43/16

[52] U.S. Cl. ..... 206/506; 206/518; 206/505; 220/331; 220/333; 220/339; 220/334

[58] Field of Search ..... 206/505, 506, 508, 515, 206/518, 519; 220/244, 329, 331, 333, 334, 337, 339, 343, 4.27, 23.6, 23.83

[56] References Cited

U.S. PATENT DOCUMENTS

| | | | |
|---|---|---|---|
| Re. 32,223 | 8/1986 | Kreeger et al. | 206/506 |
| Re. 33,384 | 10/1990 | Miller et al. | 206/518 |
| 2,112,451 | 3/1938 | Best et al. | 206/506 |
| 2,874,866 | 2/1959 | Rudy | 220/333 |
| 3,376,046 | 4/1968 | Kivett et al. | 206/506 |
| 4,109,791 | 8/1978 | Clipson et al. | 206/506 |
| 4,685,567 | 8/1987 | Webb | 206/518 |
| 4,765,480 | 8/1988 | Malmanger | 206/518 |
| 4,848,578 | 7/1989 | Schafer | 206/506 |
| 4,947,992 | 8/1990 | Schafer | 206/506 |

FOREIGN PATENT DOCUMENTS

| | | | |
|---|---|---|---|
| 214494 | 4/1924 | United Kingdom | 220/333 |
| 1574117 | 9/1980 | United Kingdom | 206/506 |

*Primary Examiner*—S. Castellano
*Attorney, Agent, or Firm*—Friedrich Kueffner

[57] ABSTRACT

A nestable transport container, particularly of plastics material has a preferably rectangular bottom and outwardly inclined side walls which are integrally connected to and extend upwardly from the bottom. The upper edges of the side walls define a container opening. The transport container includes stacking flaps as well as cover halves for closing the container opening. The stacking flaps have border ledges, wherein the cover halves rest on the border ledges when the container opening is closed. In the closed state of the transport container, the upper surfaces of the cover halves are slightly lower than the stacking surfaces of the stacking flaps.

10 Claims, 3 Drawing Sheets

FIG.4
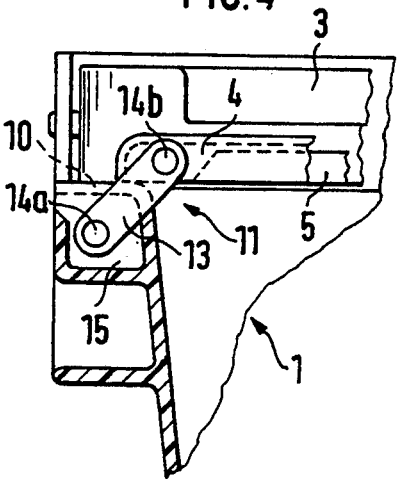
FIG.5
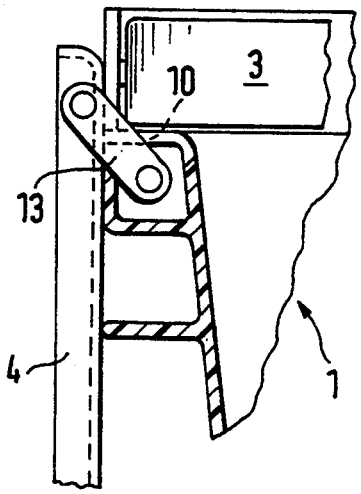
FIG.6
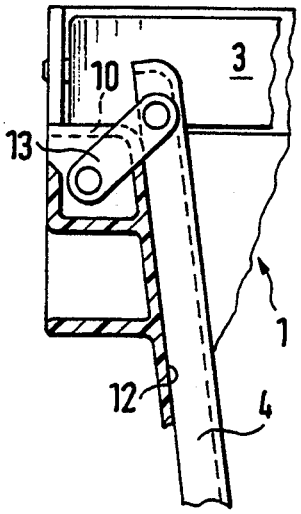
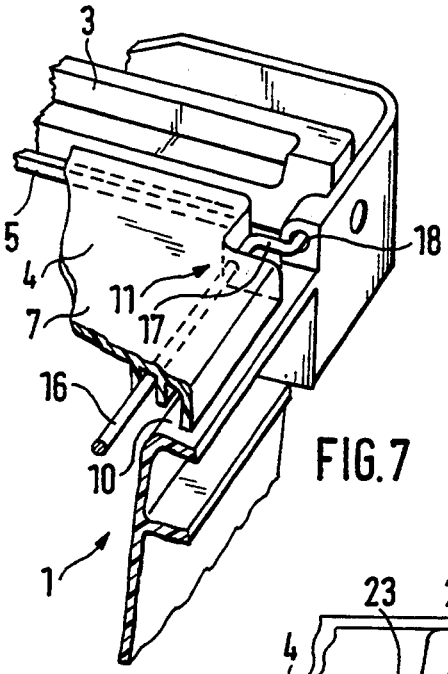
FIG.7
FIG.8
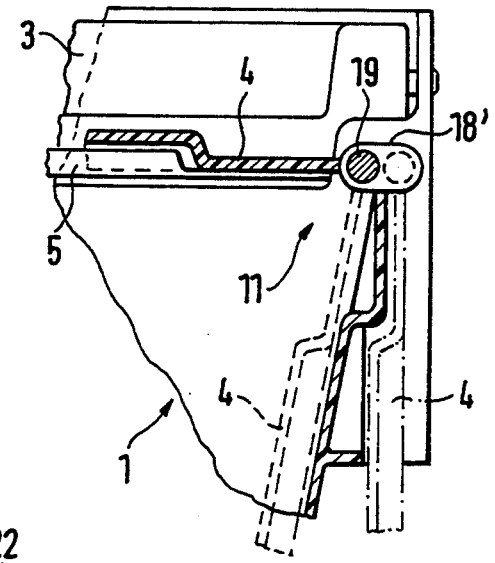
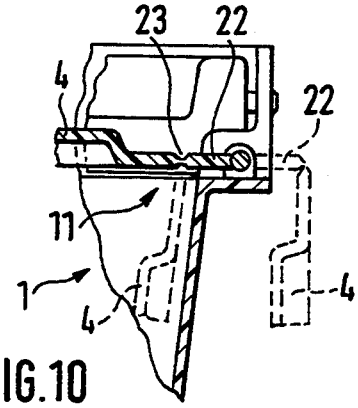
FIG.10
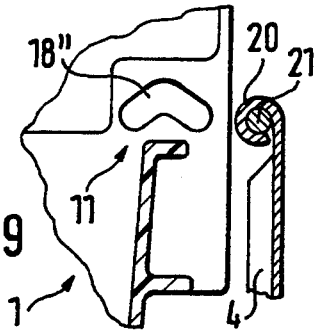
FIG.9

NESTABLE TRANSPORT CONTAINER

BACKGROUND OF THE INVENTION

1. Field of the Invention

The present invention relates to a nestable transport container, particularly of plastics material. The transport container has a preferably rectangular bottom and outwardly inclined side walls which are integrally connected to and extend upwardly from the bottom. The upper edges of the side walls define a container opening.

2. Description of the Related Art

Transport containers of the above-described type are known on the market. If the transport containers are used for shipping goods over longer distances, it is also known in the art to close the container openings with separate, removable covers.

However, it has been found in this connection that, when the empty containers are shipped back nested into one another, the loose covers must be collected and must be returned separately. This causes losses.

In accordance with a solution which has become known on the market, the loose covers can be folded together by a central transverse hinge and can be placed on the bottom of each container. However, since the covers are still separate from the containers, losses cannot be avoided.

The aforementioned losses do not occur in another known solution in which longitudinally divided covers forming so-called cover halves are permanently connected through hinges to the longitudinal sides of the containers. However, these containers can only be nested into one another for return shipment after the cover halves have been folded out previously.

While the solution with the longitudinally divided cover is practical, it has a disadvantage which becomes more serious when the containers are nested into each more deeply. Thus, the cover halves which are folded out on both sides of the container inevitably come to rest on top of one another in a scale-like manner and spread outwardly from the containers, so that valuable storage space is lost when several container columns are placed next to each other, for example, in a truck container or hold. In addition, the cover halves which overlap each other in a scale-like manner impact each other from column to column, so that the occurring impact forces which are considerable must be absorbed by the sensitive hinges of the cover halves.

The same danger exists for the hinges during in-house operations, when the open containers are conveyed on conveyor tracks prior to and after filling of the containers and the folded-out cover halves come into contact with each other when the containers travel in curves of the conveyor track. This is because the folded-out cover halves project outwardly beyond the border edges of the containers. In addition, the cover halves which are relatively flat must absorb undesirable loads when filled containers with their folded-in cover halves are stacked on top of each other.

SUMMARY OF THE INVENTION

Therefore, it is the primary object of the present invention to provide a nestable transport container of the above-described type in which the cover for closing the container opening no longer has the many disadvantages described above.

In accordance with the present invention, the nestable transport container includes stacking flaps as well as cover halves for closing the container opening. The stacking flaps have border ledges, wherein the cover halves rest on the border ledges when the container opening is closed. In the closed state of the transport container, the upper surfaces of the cover halves are slightly lower than the stacking surfaces of the stacking flaps.

The surprising result of the configuration according to the present invention is the fact that the longitudinal sides of the cover halves are shortened, so that when the cover halves are folded out, the border edges at the end faces of the transport container according to the present invention are free around the corners and, on conveyor tracks, particularly in curves of conveyor tracks, the cover halves cannot impinge against the cover halves of other containers, so that the hinges no longer have to absorb the impact loads. Moreover, the stacking flaps absorb the loads of stacked containers, while the cover halves remain free of loads and, as a result, can be constructed of lighter weight, for example, without distortion from punched-out material.

In accordance with a particularly advantageous further development of the invention, the cover halves are hinged to the longitudinal rims of the containers in such a way that the cover halves can be folded outwardly and, when the stacking flaps have previously been folded out into the position of rest thereof, the cover halves can also be folded inwardly into the interior of the container.

This feature of the present invention provides the additionally surprising result that the containers can be nested into one another without it being necessary that the cover halves assume an outwardly spread-out position outside of the container which would mean that the cover halves are unprotected and use up valuable storage space.

Additional important further developments of the present invention are directed to different embodiments of hinges which make it possible to fold the cover halves outwardly as well as inwardly. In accordance with another feature, when the containers are nested into one another, only the border edges at the end faces contact each other for carrying the load and the longitudinal edges are kept free for receiving the hinges. The border edges at the end faces additionally have grips and the stacking flaps have reduced thickness portions for making the grips accessible.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 4 is a sectional view taken along sectional line IV—IV of FIG. 1;

FIG. 5 is the same sectional view as FIG. 4, however, with the cover half being folded outwardly;

FIG. 6 is the same sectional view as FIG. 4, however, with the cover half folded inwardly;

FIG. 7 is a perspective view of a container corner with a wire stirrup as the hinge of the cover half;

FIG. 8 is a sectional view through the longitudinal edge of the container with an oblong bearing opening for a cover half;

FIG. 9 is a sectional view through the longitudinal edge of the container with an angular bearing opening;

FIG. 10 is a sectional view through the longitudinal edge of the container with a cover half hinged to a flap ledge through a film-type hinge;

DETAILED DESCRIPTION OF THE PREFERRED EMBODIMENTS

Figure 1:
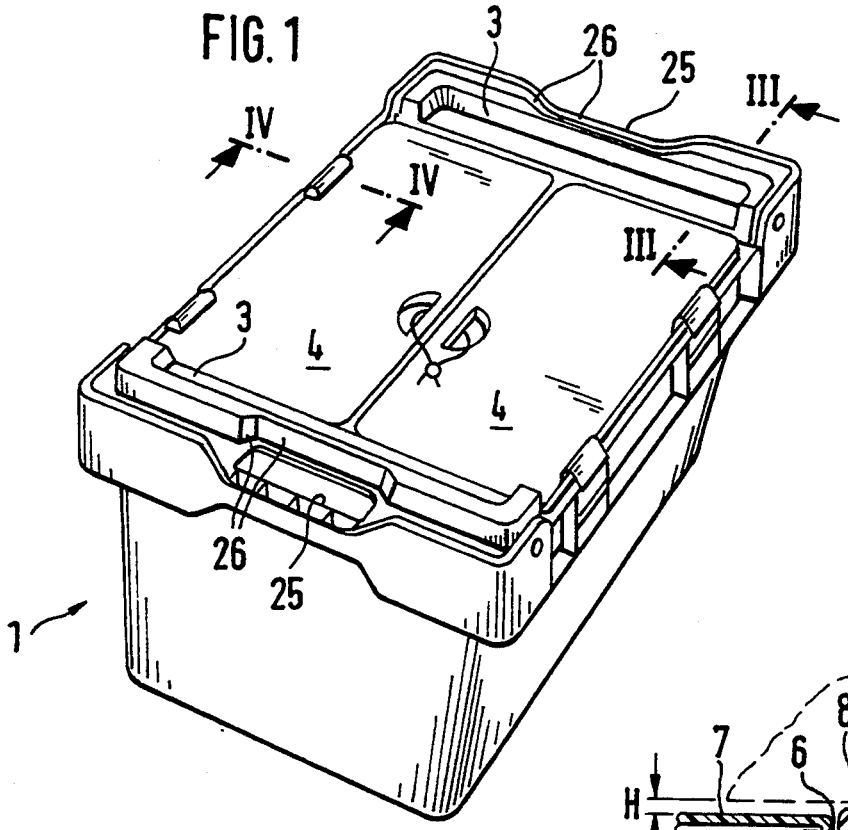
FIG. 1 is a schematic perspective view of the nestable transport container according to the present invention in the closed state.
Figure 2:
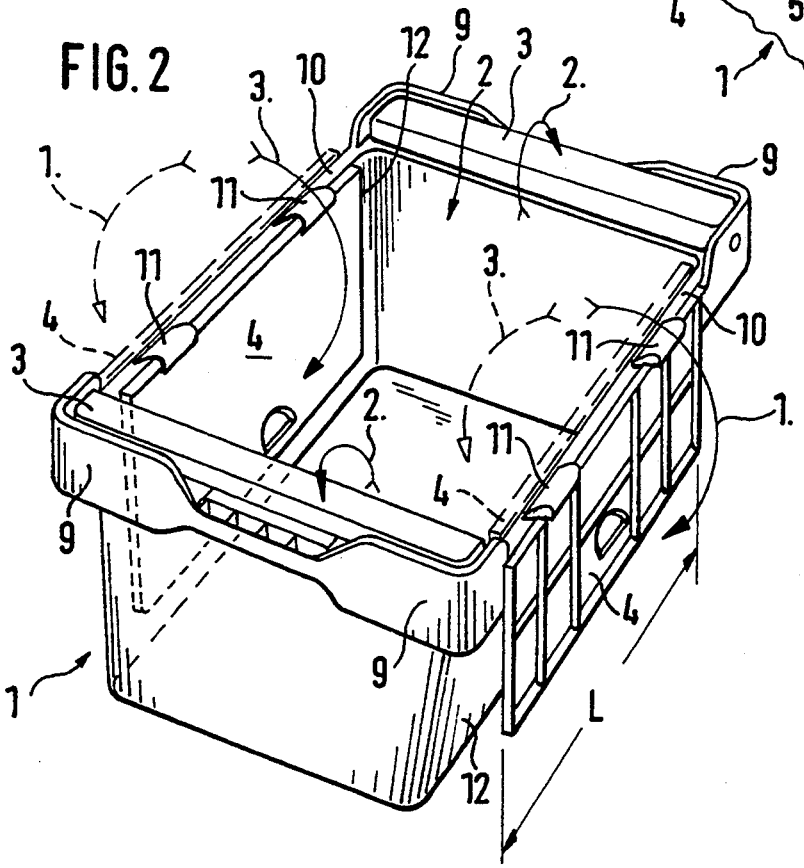
FIG. 2 is a perspective view of the container of FIG. 1 shown in the open state.

The container 1 according to the present invention is shown in FIG. 1 in the closed state. FIG. 2 of the drawing shows the container 1 in the open state. The container 1 has a container opening 2 which is closed by means of stacking flaps 3 as well as cover halves 4 which are laterally supported by means of the stacking flaps 3.

Figure 3:
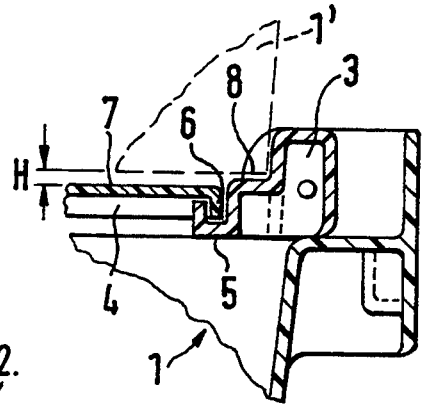
FIG. 3 is a sectional view taken along sectional line III—III of FIG. 1.

As illustrated in the sectional view of FIG. 3, the cover halves 4 are supported by gutter-like border ledges 5 which are integrally connected to the stacking flaps 3. The short edges 6 of the cover halves 4 engage behind the border ledges 5 when the stacking flaps 3 are folded inwardly into the position of operation thereof. In this position, the upper surfaces of the cover halves 4 are slightly lower by a distance H than stacking surfaces 8 of the stacking flaps 3, so that the load from another container 1' stacked on top of container 1 only acts on the stacking surfaces 8.

As can be seen in FIG. 2, the combination with the stacking flaps 3 makes it possible that the cover halves 4 have a significantly reduced length L, so that the border edges 9 of the container 1 at the end faces thereof can impact without problems on the same border edges of other containers of the same type. This is of particular advantage when the containers travel on conveyor tracks.

As is additionally apparent from FIG. 2, the cover halves 4 are hinged by hinge means 11 to the longitudinal edges 10 of the container 1 in such a way that the cover halves 4 can be folded outwardly as well as inwardly into the container. In the latter case, the cover halves 4 are in a particularly protected position when the container 1 is nested together with additional containers of the same type.

As indicated by arrows 1, 2 and 3 in FIG. 2, the container is used as follows:

1. Starting from a closed container, the cover halves 4 are initially folded outwardly;
2. The stacking flaps 3 which are now released are folded from the position of operation into the position of rest shown in FIG. 2; in the position of rest, the stacking flaps 3 are positioned protected behind the border edges 9 of the container 1;
3. The cover halves 4 are lifted and folded into the interior of the container 1 where they rest against the side walls 12 of the container 1; another container of the same type can now be nested into this container 1.

The sectional views of FIGS. 4 to 6 show a hinge means 11 in the form of a joint piece 13 which, as is apparent from the perspective view of FIG. 2, is ledge-shaped. The joint piece 13 is fastened by means of pins **14*a* in troughs 15 of the longitudinal edges 10 of the container. The joint piece 13 can be tilted about pins 14*a*. Pins 14*b* connect the joint piece 13 to the cover half 4 in such a way that the cover half 4 can be swung over the longitudinal edge 10 inwardly into the interior of the container as well as outwardly out of the container. When the stacking flaps 3 are in the position of rest as shown in FIG. 5, it is possible to fold the cover halves 4 outwardly or, as shown in FIG. 6, toward the inside, wherein, in the latter case, the cover half 4 rests against the side wall 12 of the container 1**.

FIG. 7 of the drawing shows a wire stirrup 16 forming the hinge means 11. The wire stirrup 16 extends inwardly offset underneath the upper surface 7 of the cover half 4 and is guided in a bearing opening 18 at the end of the longitudinal edge 10 through a bent portion 17 outside of the cover half 4.

The hinge means 11 shown in FIG. 8 is composed of a border bead 19 integrally formed on the cover half 4. At its free, pin-like end, not shown, the border bead 19 engages in an oblong bearing opening 18', so that a horizontal displacement of the support of the cover half 4 can be carried out within the bearing opening 18'.

FIG. 9 shows a hinge means 11 formed by an angular bearing opening 18". This hinge means better secures the cover halves 4 in the end positions thereof. In FIG. 9, the cover half 4 is shown prior to mounting. In this case, the cover half 4 is composed of metal and has a rolled portion 20 for holding axial rods 21.

FIG. 10 shows another hinge means 11 which is essentially composed of a flap ledge 22 and a film-type hinge 23 connecting the cover half 4 to the flap ledge 22.

Figure 11:
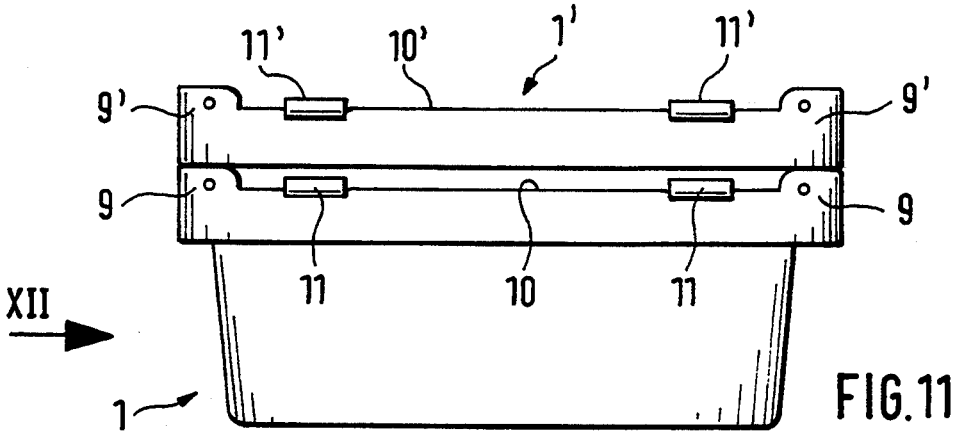
FIG. 11 is a side view of two nested containers.

The side view of FIG. 11 clearly shows that, when a container 1' is nested in a lower container 1, only the areas of the border edges 9 and 9' of the two containers 1 and 1' rest on each other, so that the longitudinal edges 10 and 10' extending between the border edges 9 and 9' are not obstructed for receiving the hinge means 11 and 11', respectively.

Figure 12:
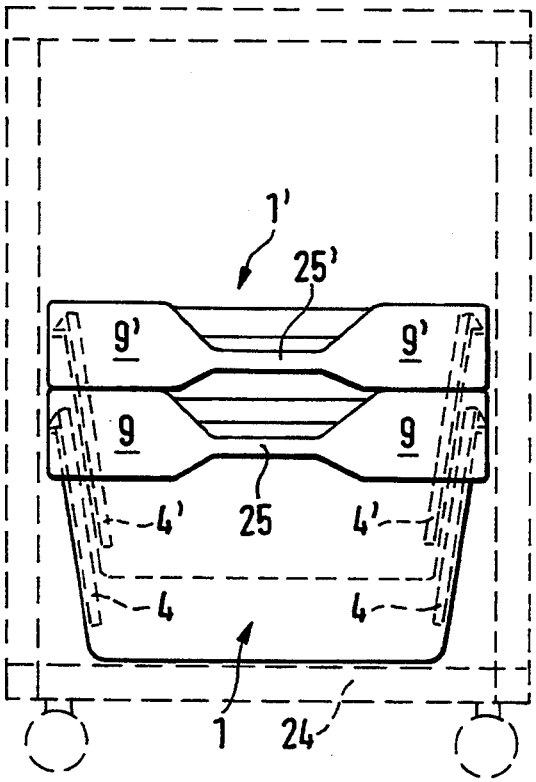
FIG. 12 is a front view of the containers seen in the direction of arrow XII of FIG. 11.

FIG. 12 of the drawing shows a front view of the two containers 1 and 1' as seen in the direction of arrow XII of FIG. 11. In FIG. 12, the containers are additionally placed in a carriage 24. Thus, it can be clearly seen that the inwardly folded cover halves 4 and 4' make possible a narrow insertion of the containers into the carriage 24. Of course, this advantage is also available, for example, when loading the transport containers into a truck container.

The grips 25 and 25' shown in FIG. 12 make it possible that the containers 1 and 1' can be easily pulled out of the carriage 24. Of course, these grips are also useful in a single container, for example, when the filled container must be carried with both hands. The grips 25 are also shown in the perspective view of FIG. 1, where it is additionally shown that indentations 26 or reduced thickness portions of the stacking flaps 3 make it possible to grasp the grips 25.

Figure 13:
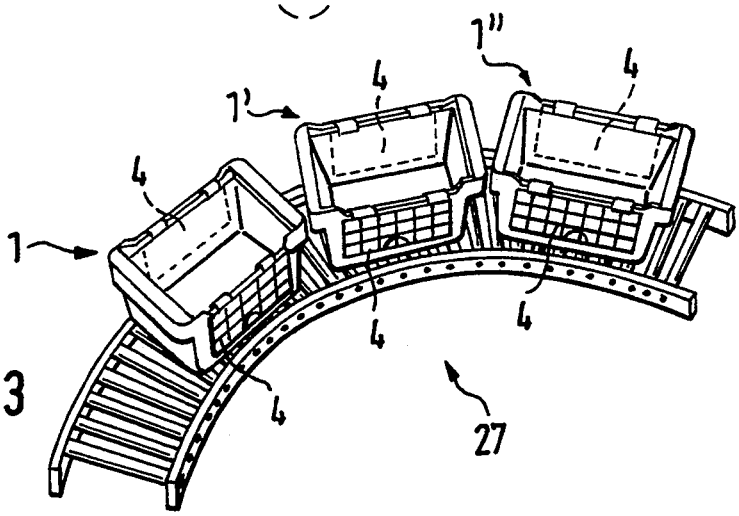
FIG. 13 is a perspective view of a conveyor track curve with containers according to the present invention.

Finally, FIG. 13 shows a curved conveyor track 27. As is apparent from FIG. 13, the reduced length L of the cover halves 4 provide the result that the containers according to the present invention do not impair each other when they travel on the conveyor track.

The invention is not limited by the embodiments described above which are presented as examples only but can be modified in various ways within the scope of protection defined by the appended patent claims.

I claim:

1. A nestable transport container comprising a rectangular bottom and outwardly inclined longitudinal and transverse side walls integrally connected to and extending upwardly from the bottom, the longitudinal and transverse side walls having upper edges defining a container opening, a container interior being defined by the longitudinal and transverse side walls, cover halves, each cover half connected by hinge means to the upper edges of the longitudinal side walls, stacking flaps, each stacking flap hinged to the upper edges of the transverse side walls, the stacking flaps being configured to swing between a position of operation facing the interior of the container and a position of rest extending away from the interior of the container, the cover halves having end edges facing the transverse side walls, the stacking flaps having gutter-like border ledges for support of the end edges of the cover halves when the stacking flaps are in the position of operation and the cover halves are swung onto the stacking flaps, the stacking flaps having stacking surfaces located outwardly from the gutter-like border ledges, the cover halves having upper surfaces, wherein, when the cover halves rest on the stacking flaps, the upper surfaces of the cover halves are located below the stacking surfaces of the stacking flaps.

2. The transport container according to claim 1, wherein the hinge means are configured to permit swinging of the cover halves into the interior of the container when the stacking flaps are in the position of rest.

3. The transport container according to claim 2, wherein the upper edges of the longitudinal side walls have indentations, the hinge means comprising ledge-like joint pieces tiltable about pins in the indentations, and additional pins for connecting the joint pieces to the cover halves.

4. The transport container according to claim 2, wherein the hinge means comprise wire stirrups extending inwardly offset and underneath the cover halves, the container having bearing openings at ends of the upper edges of the longitudinal side walls, the wire stirrups having bent ends extending outside of the cover halves and being received in the bearing openings.

5. The transport container according to claim 2, wherein the cover halves have longitudinal edges facing the upper edges of the longitudinal side walls, the longitudinal edges of the cover halves comprising border beads having pin-like ends, the container having oblong bearing openings at ends of the upper edges of the longitudinal side walls, the pin-like ends being received in the oblong bearing openings, such that a horizontal displacement of the border beads is possible.

6. The transport container according to claim 2, wherein the cover halves have longitudinal edges facing the upper edges of the longitudinal side walls, the longitudinal edges of the cover halves comprising border beads having pin-like ends, the container having angular bearing openings at ends of the upper edges of the longitudinal side walls, the pin-like ends being received in the angular bearing openings, such that an angular displacement of the border beads is possible.

7. The transport container according to claim 6, wherein the border beads are rolled-up cover half portions, an axial rod extending through the rolled-up portion and having the pin-like ends received in the angular openings.

8. The transport container according to claim 2, wherein the hinge means comprise flapping ledges and film-type hinges connecting the cover halves to the flapping ledges.

9. The transport container according to claim 1, wherein the transverse side walls of the container has border edges, and wherein the border edges rest on one another when two or more containers are nested into one another.

10. The transport container according to claim 9, wherein the border edges comprise grips and the stacking flaps have reduced thickness portions for making the grips accessible.

* * * * *